US008585180B2

(12) United States Patent
Bhowmik et al.

(10) Patent No.: US 8,585,180 B2
(45) Date of Patent: Nov. 19, 2013

(54) PROTECTIVE COATING FOR PRINT HEAD FEED SLOTS

(75) Inventors: Siddhartha Bhowmik, Salem, OR (US); Rio Rivas, Corvallis, OR (US); Gerald R. Wonnacott, Bend, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/389,709

(22) PCT Filed: Oct. 28, 2009

(86) PCT No.: PCT/US2009/062406

§ 371 (c)(1), (2), (4) Date: Feb. 9, 2012

(87) PCT Pub. No.: WO2011/053288

PCT Pub. Date: May 5, 2011

(65) Prior Publication Data

US 2012/0139997 A1 Jun. 7, 2012

(51) Int. Cl.
*B41J 2/135* (2006.01)

(52) U.S. Cl.
USPC ..... 347/45

(58) Field of Classification Search
USPC ..... 347/45
See application file for complete search history.

(56) References Cited

U.S. PATENT DOCUMENTS 6,497,802 B2 12/2002 Fu
6,582,569 B1 6/2003 Chiang et al.
6,664,633 B1 12/2003 Zhu
6,797,620 B2 9/2004 Lewis et al.
6,893,541 B2 5/2005 Chiang et al.
6,902,872 B2 6/2005 Lai et al.
6,942,318 B2 * 9/2005 Fartash ..... 347/44
6,958,296 B2 10/2005 Chen et al.
7,432,582 B2 10/2008 Lai et al.
7,517,060 B2 4/2009 Hess et al.
7,552,533 B2 6/2009 Fartash
2002/0064592 A1 5/2002 Datta et al.
2004/0112735 A1 6/2004 Saigal et al.
2006/0164204 A1 * 7/2006 Nishiwaki et al. ..... 338/200
2007/0019032 A1 * 1/2007 Maekawa et al. ..... 347/45
2008/0102630 A1 5/2008 Saito

FOREIGN PATENT DOCUMENTS

JP 2002264332 9/2002
JP 2004090279 3/2004

* cited by examiner

*Primary Examiner* — Matthew Luu
*Assistant Examiner* — Michael Konczal

(57) ABSTRACT

A method of method of making a corrosion resistant print head die comprises creating a self-ionized plasma (SIP) of a coating material; establishing a bias on a print head die comprising a plurality of feed slots (40), each feed slot (40) comprising side wall surfaces (61); and causing the coating material plasma to be deposited on the surfaces to form a protective coating, wherein at least a portion of the coating material is deposited on at least a portion of the surfaces by resputtering. In some cases, the feed slots have an aspect ratio greater than 2. In some cases, the feed slot comprises at least one rib (41), each rib (41) comprising a top surface (68), two side surfaces (66), and an under surface (69), and the formed protective coating is deposited on the top surface (68), two side surfaces (66), and under surface (69) of each rib (41).

14 Claims, 7 Drawing Sheets

PROTECTIVE COATING FOR PRINT HEAD FEED SLOTS

BACKGROUND

Printing devices utilize print heads to selectively deposit fluid, such as inks, onto print media. In many cases, the print heads degrade over time due to ink corrosion, thus reducing print quality.

BRIEF DESCRIPTION OF THE DRAWINGS

For a detailed description of exemplary embodiments of the invention, reference will now be made to the accompanying drawings. The drawings are not necessarily drawn to scale unless otherwise specified.

NOTATION AND NOMENCLATURE

Figure 1:
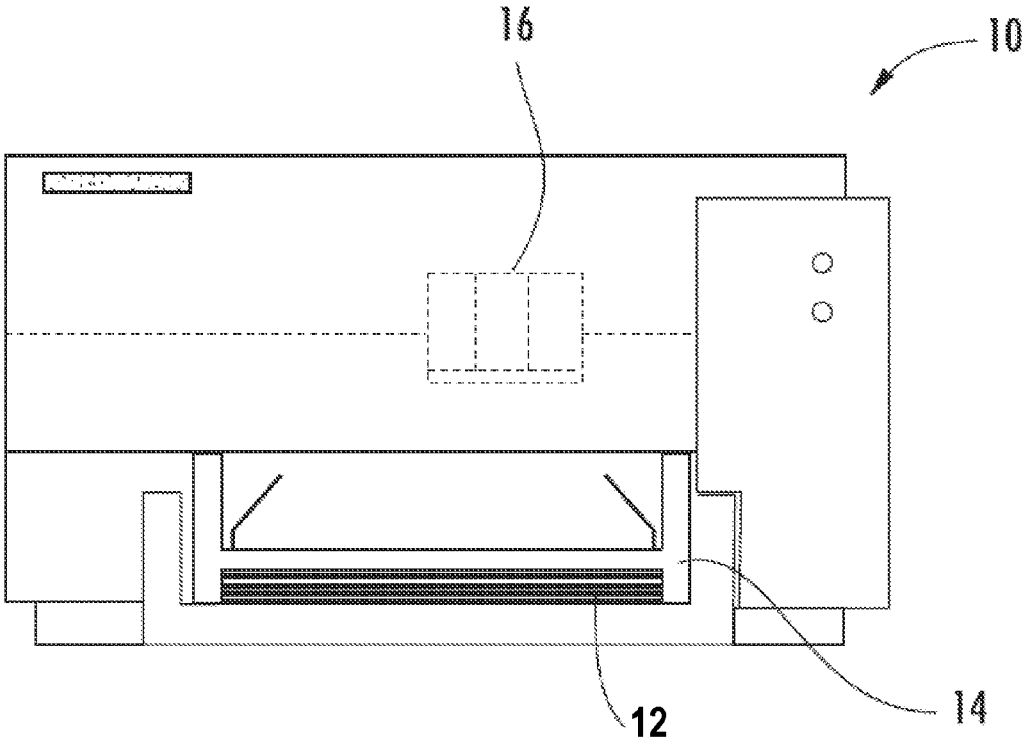
FIG. 1 is a front elevational view of a printer in accordance with various embodiments.

Certain terms are used throughout the following description and claims to refer to particular system components. As one skilled in the art will appreciate, printer companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ."

In this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" means that two members are directly or indirectly joined such that motion may be transmitted from one member to the other member directly or via intermediate members.

In this disclosure, the term "protective coating" refers to a coating comprising at least one layer of material which protects silicon (Si) feed slots from ink corrosion (i.e., chemical etching or physical damage to the feed slot by one or more component of the ink and/or by fluid forces of the ink), unless otherwise specified.

In this disclosure, the term "sputtering" refers to a direct physical bombardment and interaction of gaseous atoms and ions onto a target material (metals) species in either atomic (neutrals) or as ions. Sputter coating refers to the deposition of the target material onto a substrate.

The term "re-sputtering" refers to material being removed from the substrate and redeposited onto other areas of the substrate due to interactions with incident energetic atoms or ions and thus is an indirect interaction between target material and gas species.

In this disclosure, the term "aspect ratio" refers to the ratio between the vertical (depth) dimension of a structure and the shortest lateral dimension of the structure. For example, the aspect ratio of an inkjet print head feed slot is the ratio between the depth of the slot and the width of the slot. For the purposes of this disclosure, the term "high aspect ratio" generally refers to a structure in which the vertical dimension is more than two times the minimal lateral width.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Printing Device

FIG. 1 illustrates an example of a printing device 10 in accordance with various embodiments. Printing device 10 is configured to print or deposit ink or other fluid onto a print media 12, such as sheets of paper or other suitable ink-receiving substrate. Printing device 10 includes a media feed 14 and one or more print cartridges 16. Media feed 14 drives or moves media 12 relative to cartridges 16 which eject ink or another fluid onto the medium. For ease of reference, inks and other ejectable fluids are referred to hereinafter as simply "ink." In the example illustrated, cartridges 16 are driven or scanned transversely across media 12 during printing. In other embodiments, cartridge 16 may be stationary and may extend substantially across a transverse width of media 12, as for example, a page wide print head.

In accordance with various embodiments, print cartridge 16 comprises a nozzle plate and a print head die that have fluid feed slots, the surfaces of which are provided with a protective coating which does not extend into the firing chamber. The protective coating inhibits or reduces corrosion of the die caused by the interaction between the die and the ink while not substantially interfering with the ejection of ink from the firing chambers and through the nozzles. As a result, print quality over the life of print cartridge 16 is enhanced and prolonged.

Figure 2:
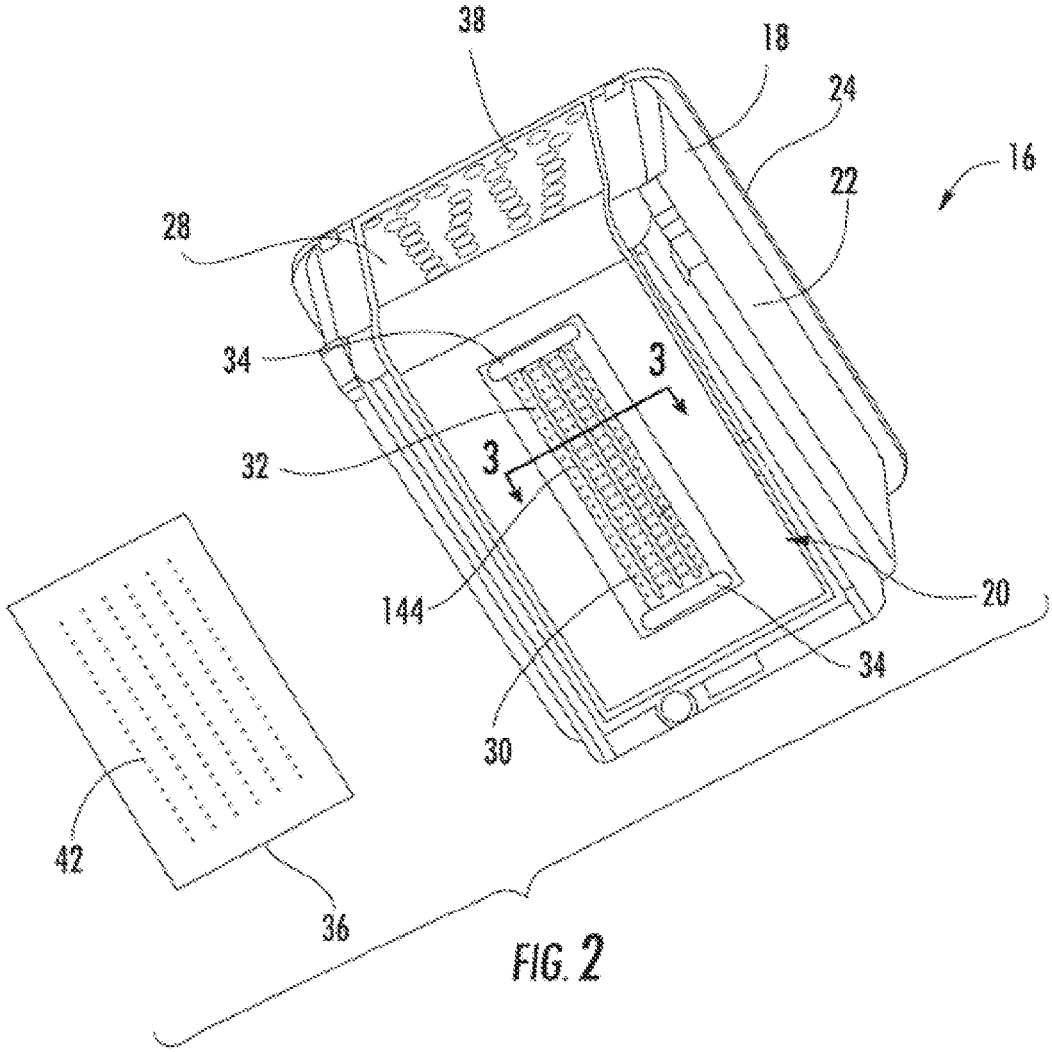
FIG. 2 is an exploded bottom perspective view of a print cartridge of the printer of FIG. 1 in accordance with various embodiments.

Although cartridge 16 is illustrated in FIGS. 1 and 2 as a modular cartridge configured to be removably mounted to or within printer 10, in other embodiments, reservoir 18 may comprise one or more structures which are a substantially permanent part of printer 10 and which are not removable.

Printer 10 may have other configurations and may comprise other printing devices which print a controlled pattern, image, layout, or the like of ink onto a surface. Examples of other such printing devices include, but are not limited to, facsimile machines, photocopiers, multifunction devices or other devices which print or eject ink.

FIG. 2 illustrates a cartridge 16 in more detail. Cartridge 16 comprises reservoir 18 and head assembly 20. Reservoir 18 comprises one or more structures configured to supply fluid or ink to head assembly 20. In one embodiment, reservoir 18 includes a body 22 and a lid 24 which form one or more internal fluid chambers that contain ink, which is discharged through slots or openings to head assembly 20. In some embodiments, the one or more internal fluid chambers additionally comprise a capillary medium (not shown) for exerting a capillary force on the printing fluid to reduce the likelihood of printing fluid leaking. In other embodiments, each internal chamber of reservoir 18 further comprises an internal standpipe (not shown) and a filter across the internal standpipe. Any other equivalent configuration of reservoir 18 may be substituted, if desired. For example, although reservoir 18 is illustrated as including a self-contained supply of one or more types of ink, reservoir 18 may also be configured to receive ink from an ink supply source via one or more conduits or tubes.

Print Head

In accordance with some embodiments, head assembly 20 comprises a mechanism coupled to reservoir 18 by which the ink is selectively ejected onto a medium. In the embodiment as illustrated by FIG. 2, head assembly 20 comprises a drop-on-demand inkjet head assembly. In one embodiment, head assembly 20 comprises a thermo-resistive head assembly. In another embodiment, head assembly 20 comprises a piezoelectric head assembly. In other embodiments, head assembly 20 may comprise any other type of device configured to selectively deliver or eject a printing fluid onto a medium. The following discussion focuses on thermal inkjet printing as an example; however, it should be understood that the methods and systems disclosed herein concerning the protective coating for the feed slots also apply to other types of inkjet printing.

In the particular embodiment as illustrated by FIG. 2, head assembly 20 comprises a tab head assembly (THA) which includes flexible circuit 28, print head die 30, firing resistors 32, encapsulate 34 and orifice plate 36. The enlarged portion in FIG. 2 show the orifice plate 36 and nozzles 42. Flexible circuit 28 comprises a band, panel or other structure of flexible bendable material, such as one or more polymers, supporting or containing electrical lines, wires or traces (not shown) that terminate at electrical contacts 38 and that are electrically connected to firing circuitry or resistors 32 on die 30. Electrical contacts 38 extend generally orthogonal to die 30 and comprise pads configured to make electrical contact with corresponding electrical contacts of the printing device in which cartridge 16 is employed. As shown in the embodiment of FIG. 2, flexible circuit 28 wraps around body 22 of fluid reservoir 18. In other embodiments, flexible circuit 28 may be omitted or may have other configurations in which electrical connection to resistors 32 and their associated addressing (or the firing circuitry) is achieved in other fashions.

Encapsulants 34 in FIG. 2 comprise one or more material which encapsulate electrical interconnects that interconnect electrically conductive traces or lines associated with die 30 with electrically conductive lines or traces of flexible circuit 28 which are connected to electrical contacts 38. In other embodiments, encapsulates 34 may have other configurations or may be omitted.

Print head die 30 (also known as a print head substrate or chip) comprises feed slots 40, ribs 41 (FIG. 3A), and the spacing between the feed slots. Print head die 30 delivers fluid to firing chambers 47 and resistors 32 via the feed slots 40. In some cases, print head die 30 supports resistors 32.

Figure 3A:
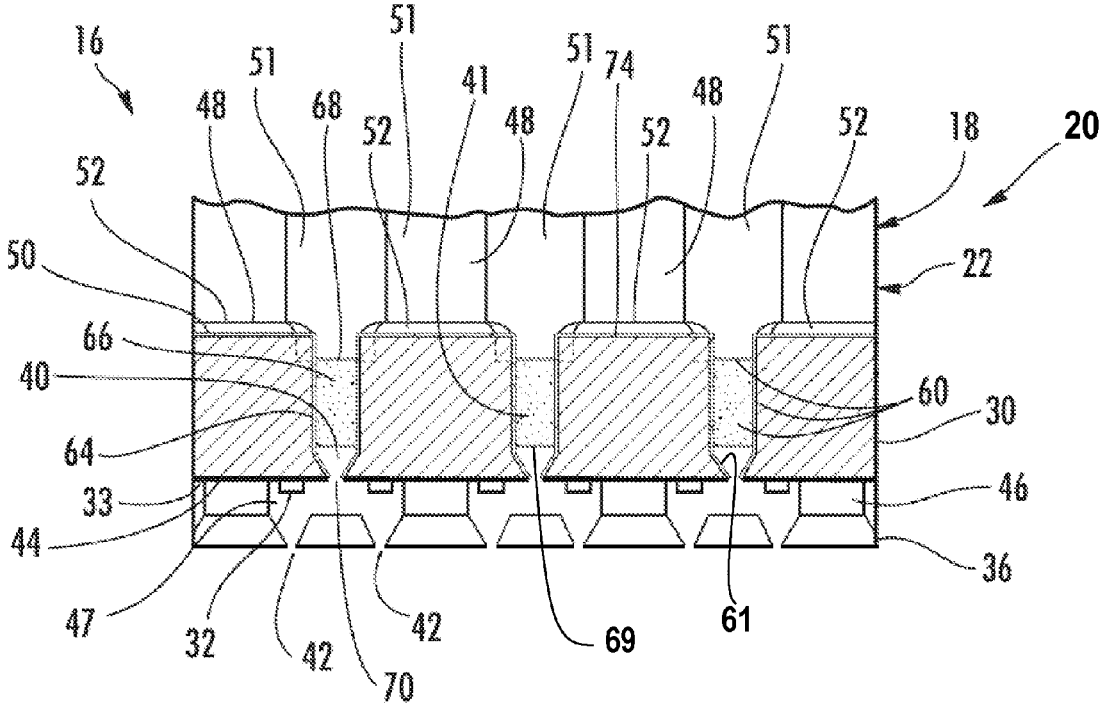
FIG. 3A is a sectional view of the cartridge of FIG. 2 taken along line 3-3, in accordance with various embodiments.

FIG. 3A is a sectional view illustrating head assembly 20 in detail, in which print head die 30 is between a lower portion of body 22 of reservoir 18 and orifice plate 36. As shown in FIG. 3A, print head die 30 has a front side 44 joined to orifice plate 36 by a barrier layer 46. Barrier layer 46 at least partially forms firing chambers 47 between resistors 32 and nozzles 42 of orifice plate 36. In one embodiment, barrier layer 46 may comprise a photo-resist polymer substrate. In one embodiment, barrier layer 46 may be formed from the same material as that of orifice plate 36. In yet another embodiment, barrier layer 46 may form orifices or nozzles 42 such that orifice plate 36 may be omitted. In some embodiments, barrier layer 46 may be omitted.

As shown by FIG. 3A, resistors 32 are supported on shelves on the bottom sides of the slot spacings and generally opposite to nozzles 42 within firing chambers 47. Resistors 32 are electrically connected to contact pads 38 (shown in FIG. 2) by electrically conductive lines or traces (not shown) supported by die 30. During use, electrical energy supplied to resistors 32 vaporizes ink supplied through slots 40 to form a bubble that forces or ejects surrounding or adjacent ink through nozzles 42. In one embodiment, resistors 32 are further connected to firing or addressing circuitry also located upon die 30. In another embodiment, resistors 32 may be connected to firing or addressing circuitry located elsewhere.

Resistors 32 comprise resistive elements or firing circuitry coupled to print head die 30 and configured to generate heat so as to vaporize portions of the ink to forcibly expel drops of printing fluid through nozzles 42 in orifice plate 36. In one embodiment, resistors 32 (schematically shown) are formed by multiple thin film layers 33 which may also form transistors, electrical routing lines, cavitation and chemical protection layers and contact pads for such resistors 32. The thin films include materials such as tantalum aluminum or tungsten silicon nitride for resistors, materials such as polysilicon, borophosphosilicate glass, and silicon oxide on doped silicon for transistors, materials such as aluminum for electrical traces, materials such as tantalum, silicon oxide, silicon nitride, and silicon carbide for cavitation and chemical protection layers, and materials such as aluminum or gold for contact pads. In yet other embodiments, the firing circuitry may have other configurations.

Body 22 of reservoir 18 includes inter-posers or headlands 48. Headlands 48 comprise those structures or portions of body 22 which are connected to die 30 so as to fluidly seal one or more chambers of reservoir 18 to a second side 50 of die 30. In an embodiment as shown in FIG. 3A, headlands 48 connect each of the three separate fluid containing chambers 51 to each of the three slots 40 of die 30. For example, in one embodiment, reservoir 18 may include three separate stand pipes which deliver fluid to each of the three slots 40. In one embodiment, each of the three separate chambers may include a distinct type of fluid, such as a distinct color of fluid or ink. In other embodiments, body 22 of reservoir 18 may include a greater or fewer number of such headlands 48 depending upon the number of slots 40 in die 30 which are to receive different fluids from different chambers in reservoir 18.

In an embodiment as shown in FIG. 3A, side 50 of die 30 is adhesively bonded to body 22 by an adhesive 52. In one embodiment, adhesive 52 comprises a glue or other fluid adhesive. In other embodiments, headlands 48 of reservoir 18 may be sealed and joined to die 30 in other fashions.

Orifice plate 36 comprises a plate or panel having a multitude of orifices which define nozzle openings through which the printing fluid is ejected. Orifice plate 36 is mounted or secured on the bottom side of slots 40 and their associated firing circuitry or resistors 32. In one embodiment, orifice plate 36 comprises a photo-imagable epoxy substrate. As shown in FIG. 2, orifice plate 36 includes a plurality of orifices or nozzles 42 through which ink or fluid heated by resistors 32 is ejected for printing on a print medium. In another embodiment, orifice plate 36 comprises a nickel substrate. In other embodiments, orifice plate 36 may be omitted where such orifices or nozzles are otherwise provided.

Prink Head Die

Figure 3B:
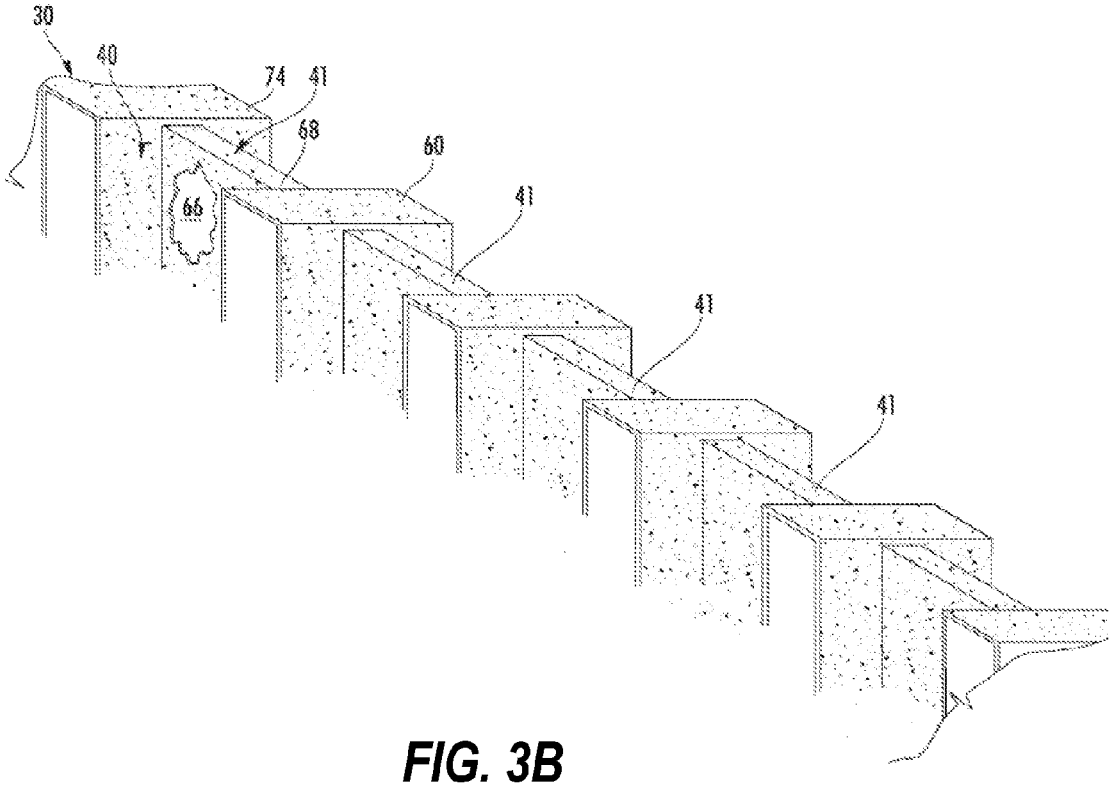
FIG. 3B is a partial 3D view of the print head die of the cartridge shown in FIG. 3A, facilitating the recognition of the different surfaces of the feed slots and rib structures, in accordance with various embodiments.

As shown in FIGS. 3A and 3B, print head die 30 comprises slots 40 and ribs 41. Ribs 41 (also known as cross beams) comprise reinforcement structures configured to strengthen and provide rigidity to those portions (bars 64) of print head die 30 between consecutive slots 40. Ribs 41 extend across each of slots 40 generally perpendicular to a major axis along which each of slots 40 extends. In one embodiment, ribs 41 and the center points of ribs 41 are made of silicon and are integrally formed as part of the single unitary body of print head die 30. Slots are formed in a Si wafer using a combination of machining process which may include laser micromachining, silicon dry etch, silicon wet etch with TMAH, and may include masking processing including patterned metal or photoresist. As will be described in more detail hereafter, ribs 41 strengthen die 30, permitting slots 40 to be more densely arranged across die 30, without substantially reducing print performance or quality. In certain embodiments, these structures are also used to physically separate two different fluids or inks. In some embodiments, print head die 30 does not have ribs 41 (or rib structures).

As rib structures are supports that strengthen the feed slots; they are especially useful in die size shrinkage. "Die size shrinkage" or "die shrinkage" generally refers to the practice of modifying the design of a die of given size by reducing the width of each feed slot as well as non slotted areas and increasing the number of dies on a wafer, or increasing the total number of feed slots in the die. One potential advantage of using a print head having an increased number of feed slots and nozzles is that higher resolution and better image quality of the printed image is possible. The spacing of the feed slots may be reduced to shrink die size by using rib structures. Alternatively, the number of feed slots may be increased by reducing the spacing using the same size die. Therefore, the number of ink colors in a given application may be increased by storing different inks in different feed slots. In some embodiments, rib structures 41 extend through the entire depth of the feed slot (through ribs) while in other embodiments the rib structure extends only partially in the vertical dimension (as illustrated in FIG. 3A).

Feed slots without ribs may also be used for die size shrinkage. These feed slots usually have high aspect ratios (e.g., greater than 2) so that sufficient amount of ink may be stored in the slots and a sufficient number of slots may be included in the die. In some cases, the feed slots have an aspect ratio of greater than 3.

As shown in the embodiment of FIG. 3A, slots 40 comprise a fluid passage 70 or fluid opening or via through which fluid is delivered to resistors 32. Slots 40 have a sufficient depth to deliver fluid to each of resistors 32 in respective firing chambers 47 and their associated nozzles 42. In some embodiments, slots 40 have tapered or sloped endings, defining fluid passage 70. In one embodiment, slots 40 have a width of between 70 microns and 700 microns, and in some cases in the range of 200 to 300 micrometers. In an embodiment as shown in FIG. 3A in which firing circuitry or resister addressing circuitry is directly provided upon the chip or die 30, slots 40 have a centerline-to-centerline pitch of approximately 0.8 mm. In embodiments where the firing or addressing circuitry is not provided upon the chip or die 30, slots 40 may have a centerline-to-centerline pitch of approximately 0.5 mm. In other embodiments, slots 40 may have other suitable dimensions and relative spacings.

Protective Coating

It has been observed that many fluids or inks, especially high performance inks, tend to corrode the one or more materials of print head die 30 over time. For example, it is been found that many high-performance inks tend to corrode the silicon from which die 30 is formed. Ribs 41 in slots 40, having a high surface area, are likewise vulnerable to ink corrosion. High performance inks typically contain one or more potentially corrosive substances such as dispersants which may have charged functionality or buffered solutions with high pH. The corroded and dissolved silicon contaminates the fluid or the ink and may affect the ejection of the ink by affecting either the quality of the ink itself or by being deposited upon resistors 32 or other components that eject the ink. It has also been found that the dissolved silicon contaminants in the fluid or the ink subsequently precipitate out of the ink and become deposited in the openings 70 or 42 to at least partially occlude such openings. In certain instances, the silicon growth in the nozzle opening 42 may create nozzle directionality issues and reduce printing performance. Thus, in some applications, ink components known to be corrosive to Si may be included in inks that are used in a coated print head assembly.

As further shown by FIGS. 3A and 3B, print head die 30 additionally comprises protective coating 60 (enlarged for purposes of illustration). Protective coating 60 addresses the above problems and expands the latitude of ink compositions that may be used in a print head by protecting the substrate, such as silicon that forms die 30 and ribs 41, from the potentially corrosive fluids or inks. As a result, in many embodiments, coating 60 reduces or prevents silicon growth about nozzle opening 42 and reduces the likelihood that the fluid or ink will be contaminated. Consequently, print quality may be maintained and the useful life of print head assembly 20 may be prolonged in many applications.

Coating Material. Coating 60 comprises one or more layers of one or more materials that are impervious to the ink components. Coating 60 has an outermost surface that is substantially inert to the fluid directed through slots 40 of print head die 30. Suitable coating materials comprise titanium (Ti), titanium nitride (TiN), tungsten (W), tantalum (Ta), or tantalum nitride (TaN). The protective coating may comprise a homogeneous single layer of a particular material or comprise multiple layers of a combination of materials. In an embodiment, the protective coating comprises a layer of Ti. In another embodiment, the protective coating comprises a layer of TiN. In a further embodiment, the protective coating comprises a layer of W. In yet another embodiment, the protective coating comprises a layer of Ta. In an embodiment, the protective coating comprises a layer of TaN. In an embodiment, the protective coating comprises a layer of Ti and a layer of TiN with the TiN layer as the outermost surface. In another embodiment, the protective coating comprises a layer of Ta and a layer of TaN with the TaN layer as the outermost surface. In yet another embodiment, the protective coating comprises a layer of Ti and a layer of W with the W layer as the outermost surface.

Coating 60 has a sufficient thickness to ensure the integrity (e.g., continuous with no cracking or breaking) of the protective coating formed on the surfaces of feed slot 40. At the same time, coating 60 is thin enough that cracking or delamination of coating 60 resulting from tensile stresses during use is avoided or minimized. In some applications, the total thickness of the protective coating is in the range of from about 50 to about 300 angstroms. In some applications, the coating is from about 75 to about 250 angstroms in thickness. In still other applications, the coating is from about 90 to about 210 angstroms in thickness. When the protective coating is very thin (e.g., less than about 300 angstroms), it is transparent in visible light and facilitates downstream die inspection. In some other applications, the total thickness of the protective coating is up to 1000 angstroms. In yet other applications, the total thickness of the protective coating is up to 2000 angstroms.

In some embodiments, when the protective coating comprises multiple layers, the stress in the protective layer is balanced to zero. For example, the Ti layer has compressive stress and the TiN layer has tensile stress. These two layers in combination result in a zero-stress protective coating that is also resistant to delamination. The stress of a deposited film is readily determined by measuring the curvature of a wafer after a film is deposited and accounting for the substrate thickness, Young's modulus of the substrate, and the thickness of the deposited film using known methods. Compressive stressed films cause the substrate to bend convex, while tensile stressed films cause the substrate to bend concave.

Coated Area. Coating 60 covers all the surfaces associated with feed slot 40, including all of the surfaces of the rib structures. In FIGS. 3A and 3B, coating 60 is formed and extends over side surfaces of die 30, side surfaces 61 of feed slots 40 (including the sloped/tapered surfaces) defining opening 70, side surfaces 66 of ribs 41, the top surfaces 68 of ribs 41, underside surface 69 of ribs 41, and the back face 74 of die 30. Consequently, coating 60 provides a protective blanket on the surface areas associated with slot 40, which may come in contact with the ink as the fluid travels through slot 40.

In an embodiment, coating 60 covers the back face 74 of die 30 (the backside of the wafer including die 30). As a result, coating 60 further protects the top surface of die 30 during contact with fluid from chambers 51. In addition, those portions of die 30 which are bonded to head lands 48 by adhesive 52 are also benefited. In particular, coating 60 improves adhesion of the materials of die 30 to the structural adhesive 52. In alternative embodiments, coating 60 either coats a portion or does not coat the back face 74 of die 30.

Figure 5:
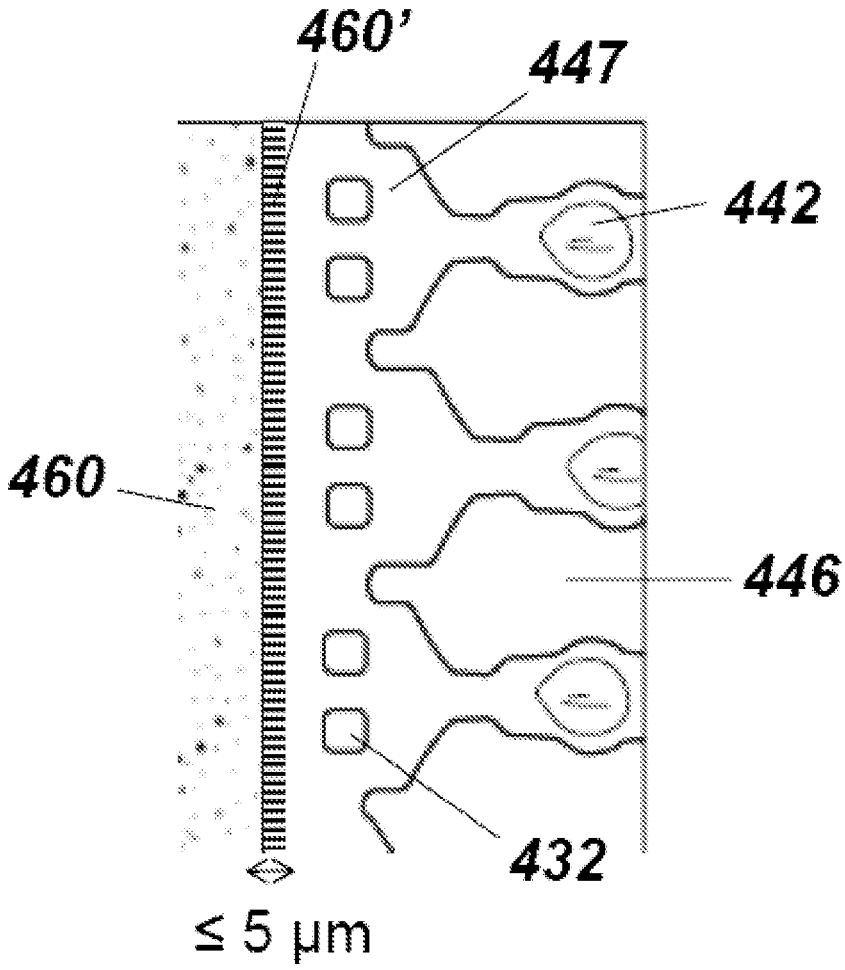
FIG. 5 is an enlarged, bottom-up view of the print head assembly from the side of the nozzles after the protective coating is deposited, in accordance with various embodiments.

As shown in FIG. 3A, coating 60 does not extend appreciably into firing chambers 47, so as not to interfere with the ejection of inks from the chambers. In one embodiment, coating 60 extends up to and along opening 70 and die 30. In other embodiments, coating 60 may additionally extend onto portions of orifice plate 36 directly opposite to openings 70. However, even in these embodiments, coating 60 does not laterally extend into firing chambers 47 or over resistors 32 or nozzles 42. FIG. 5 is a bottom-up view of an embodiment of a print head assembly from the side of the nozzles after the protective coating is deposited. Coating 460 does not extend into the firing chamber 447 for more than 5 microns (shaded area, 460'). In some cases, coating 460 does not spread into the firing chamber 447 for more than 4 microns. In some cases, coating 460 does not spread into the firing chamber 447 for more than 7 microns. Coating 460/460' does not interfere with the function of resistors 432, nozzles 442, or barrier layer 446.

Because the coverage of coating 60 is controlled and limited so as to not extend appreciably into firing chambers 47 as discussed below under "SIP method," coating 60 does not interfere with the firing properties, such as a turn on energy, of resistors 32 or those fluid ejection characteristics achieved by the overall firing system. This may be especially important where coating 60 is formed from materials having a relatively low thermal conductivity (a thermal conductivity much lower than the material of resistors 32), which would otherwise impact the ejection of fluid within each firing chamber 47.

SIP method

The coating material may be deposited using self-ionized plasma (SIP) physical vapor deposition technology that is known in the art. For example, SIP deposition apparatus and procedures as described in US Pat. App. No. 20040112735 may be suitably employed for this purpose.

In some cases, coating 60 needs to be kept away from certain surfaces of the print head assembly (such as the resistor surfaces). This may be achieved by conventional techniques such as shadow masking or liftoff, which are known methods in the art. For chemical vapor deposition (CVD) and atomic layer deposition (ALD), masking or liftoff is often necessary to avoid spreading the coating to unwanted area. However, masking or liftoff is not necessary for the SIP vapor deposition method disclosed herein. Therefore, the SIP vapor deposition method reduces the complexity of the coating process.

In an embodiment, the print head die with feed slots is sputtered prior to being assembled with the print head architecture (including firing chamber, nozzles, and other relevant structures). In some embodiments, the die is similar to die 30 shown in FIG. 3A, without thin film layers 33, resistors 32, barrier layer 46, orifice plate 36, firing chambers 47, or nozzles 42.

Figure 4A:
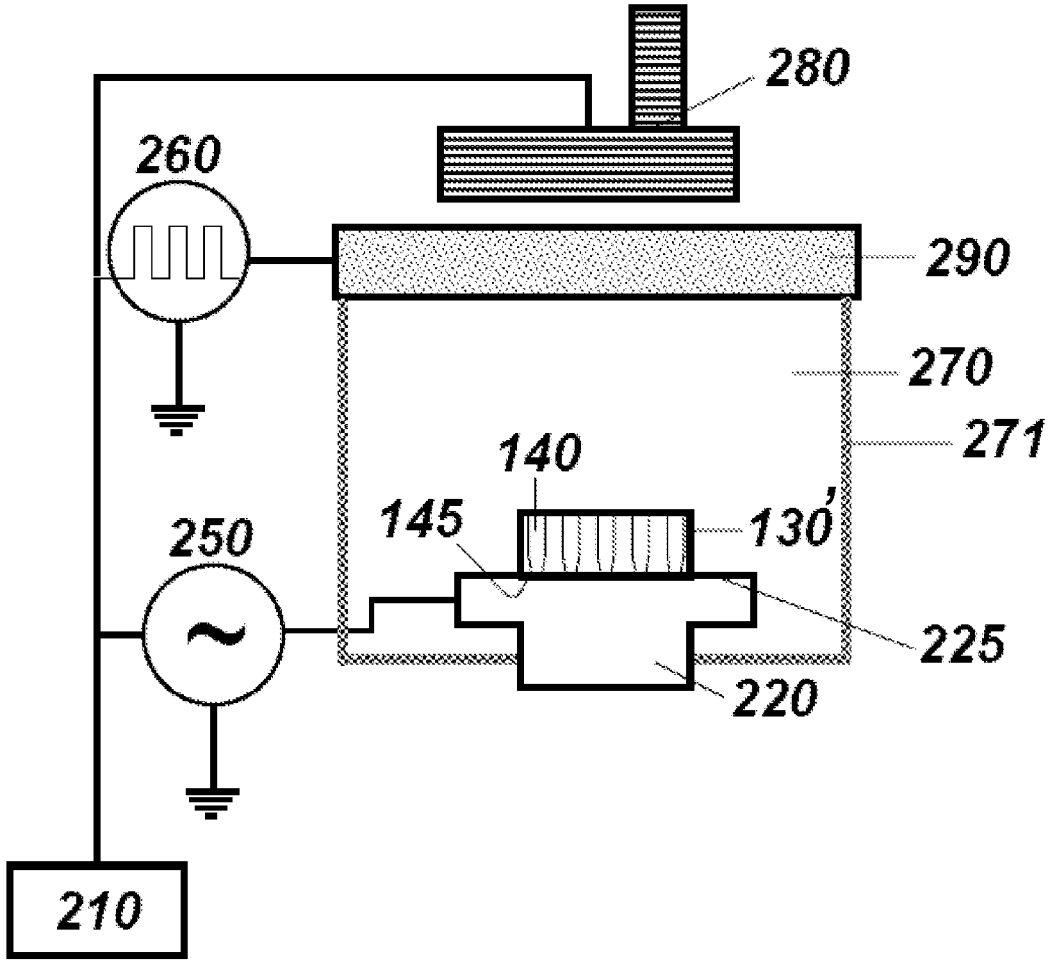
FIG. 4A is a schematic illustration of a coating system for using self-ionized plasma (SIP) physical vapor deposition (PVD) to produce a protective coating on a print head die, in accordance with various embodiments.
Figure 4B:
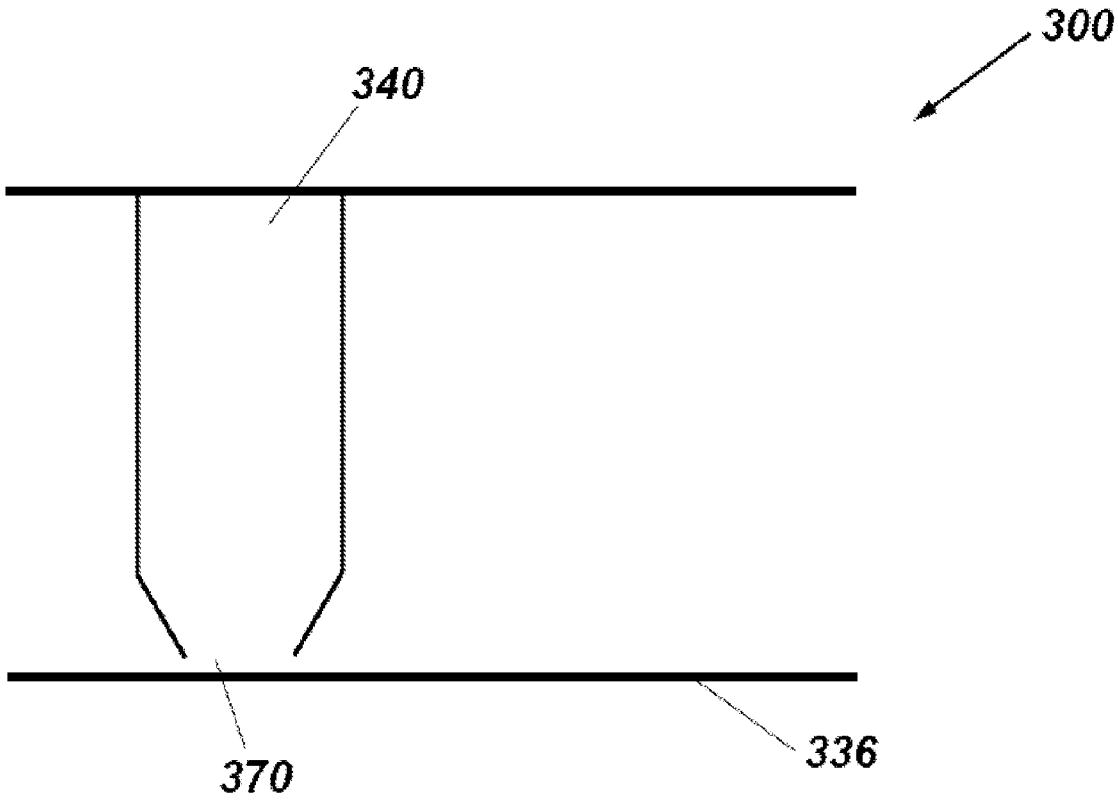
FIG. 4B is a simplified expanded view of the print head die-architecture assembly used in a SIP vapor deposition process, in accordance with various embodiments.

In another embodiment, as shown in FIG. 4A, the print head die with feed slots 140 is sputtered after the print head architecture (including firing chambers, nozzles, and other relevant structures) is attached to the die. The die with the architecture is called the die-architecture assembly (DAA) 130'. In FIG. 4B, a portion 300 of DAA 130' in FIG. 4A is expanded to illustrate the relative scale of a slot 340 and the distance between the slot opening 370 and the orifice plate 336. For example, the width of slot 340 is about 200 microns, the width of the opening 370 is about 100 microns, and the distance between the slot opening 370 and the orifice plate 336 is about 15 microns. Because the distance between the slot opening 370 and the orifice plate 336 is much smaller compared to the dimension of the slot and the slot opening, the SIP vapor deposition method used herein does not spread the protective coating into the firing chamber for more than 5 microns (FIG. 5). In some cases, the coating does not spread into the firing chamber for more than 4 microns. In some cases, the coating does not spread into the firing chamber for more than 7 microns. The coating material plasma may come through opening 370 and coats a portion of plate 336. But due to the small distance between 370 and 336, very little coated material is resputtered laterally. Therefore, the protective coating does not extend into the firing chambers appreciably. Furthermore, resputtering from plate 336 through opening 370 may facilitate the coating of the underside surface of the rib structures.

Referring to FIG. 4A again, the SIP reactor comprises a sealed vacuum chamber 270. The vacuum chamber walls 271 are usually made of metal and are electrically grounded. In some cases, an inert gas (e.g., argon) is flowed into the chamber in a controlled manner (not shown in FIG. 4A). The reactor also comprises a target 290, which has at least a surface portion composed of the material to be sputter deposited on DAA 130'. A DC magnetron 280 is coupled to the target 290 and generates a plasma adjacent to the target for sputtering the target and ionizing the sputtered deposition material. The DC magnetron is powered by a DC electrical source 260. The magnetron is scanned about the back of the target and projects its magnetic field into the portion of the reactor adjacent the target to increase the plasma density. The target 290 is typically negatively biased to attract the ions generated in the plasma to sputter the target.

A pedestal electrode 220 has a support surface 225 which supports the DAA 130' and biases the DAA 130' to attract ionized deposition material. DAA 130' is removably fixed on the support surface 225 of the pedestal electrode 220 on its front side or orifice plate 145. The pedestal electrode 220 is powered by an AC power source 250. Resistive heaters, refrigerant channels, and a thermal transfer gas cavity in the pedestal 220 may be provided to allow the temperature of the pedestal to be controlled to temperatures of less than −40° C., thereby allowing the die temperature to be similarly controlled. The DAA 130' is placed on the pedestal electrode 220 with the wide portion of the feed slots facing toward target 290.

The SIP PVD reactor comprises a controller 210, which in some cases controls the magnetron 280, the DC power source 260, and the AC power source 250. In an embodiment, process conditions for the SIP vapor deposition process are chamber pressure in the range of 0.5 to 2 millitorr, argon gas flow into the chamber in range of 10 to 15 SCCM, pedestal gas flow in the range of 3 to 6 SCCM, pedestal temperature in the range of −50° C. to 130° C., DC power in the range of 8 to 25 kilowatts, AC bias in the range of 230 to 270 watts, and deposition time in the range of 5 to 90 seconds based on target thickness and process conditions.

The rate at which material is sputtered may be controlled by controlling the power of the source biasing the target. Because a relatively thin layer deposition is often desired, a low sputtering rate is often used to facilitate controlling the thickness of deposition. Consequently, the power level of the target biasing source may be set relatively low to assist in achieving the desired thin layer deposition. For example, at a sufficiently high plasma density adjacent a target, a sufficiently high density of target metal ions can develop that ionizes additional metal sputtered from the target. As noted above, such a plasma is referred to as a self-ionizing plasma (SIP). The sputtered metal ions may be accelerated across the plasma sheath and toward a biased substrate, thus increasing the directionality of the sputtered material. In this case, the biased substrate is the DAA 130'. The increased energetics of the impinging ion and deposited material on non vertical planes of the substrate/slot allow material to be resputtered on vertical sidewalls. Coating of vertical sidewalls is a challenge in conventional physical vapor deposition (PVD) systems especially in high aspect ratio structures. As a result, sidewall and bottom coverage in deep and narrow slots may be improved by the present SIP method.

SIP is able to deposit material into high aspect ratio feed slots and the underside surface 69 of rib structures 41 (FIG. 3A). This is because SIP creates a high degree of ionization of atoms; the bias on the substrate allows the created ions to be accelerated towards the substrate so that a sufficient amount of ions reaches the bottom of high aspect ratio structures. Furthermore, ion bombardment from accelerated ions re-sputters material from the non vertical planes to coat the side-walls 61 and 66, as illustrated in FIGS. 3A and 3B. As shown in FIGS. 3A and 3B, protective coating 60 is deposited upon surfaces 61, 66, 68 and 69 by the SIP PVD method. Coating of the rib undersides (rib surface 69) is difficult in conventional PVD methods due to shadowing of that structure in any directional processes. Resputtering in the SIP method allows this protection and in turn prevents ink attack on this surface.

When the resulted coated die is used for printing, protective coating 60 (FIG. 3A) allows print head assembly 20 to maintain desired levels of quality over a prolonged period of time. Coating 60 inhibits or prevents fluids or inks from corroding die 30. Coating 60 inhibits contamination of the fluid or ink cause by solvation of die material. Coating 60 also inhibits the deposition, build up or growth of the dissolved material of die 30 about opening 70 or nozzle openings 42 and upon resistors 32. At the same time, coating 60 does not interfere with the fluid ejection from the print head. Coating 60 facilitates the printing of fluids or inks that may be more corrosive to the material of die 30 yet may provide enhanced performance. Coating 60 provides greater flexibility in the selection of fluid or ink formulations. In some applications, an array of coated dies is utilized to assemble page-wide print heads. In some applications, the coated die is used as a component for an inkjet cartridge.

In an embodiment, a method of making a corrosion resistant print head die is described. The method comprises creating a self-ionized plasma (SIP) of a coating material; establishing a bias on a print head die comprising a plurality of feed slots (40), each feed slot (40) comprising side wall surfaces (61); and causing the coating material plasma to be deposited on the surfaces mentioned above to form a protective coating, wherein at least a portion of the coating material is deposited on at least a portion of the surfaces by resputtering. In some cases, the feed slots have an aspect ratio greater than 2. In some further embodiments, the feed slot comprises at least one rib (41), each rib (41) comprising a top surface (68), two side surfaces (66), and an under surface (69), and the formed protective coating is deposited on the top surface (68), two side surfaces (66), and under surface (69) of each rib (41).

In some cases, the coating material is selected from the group consisting of titanium (Ti), titanium nitride (TiN), tungsten (W), tantalum (Ta), tantalum nitride (TaN) and combinations thereof. In some cases, the protective coating comprises at least two layers of the material. For example, the protective coating comprises a layer of titanium (Ti) and a layer of titanium nitride (TiN), wherein the layer of titanium nitride (TiN) is outermost. In some embodiments, the formed protective coating has zero stress. In applications, the protective coating is capable of protecting the coated surfaces from ink corrosion. In some applications, the protective coating is transparent under visible light.

In another embodiment, a print head is disclosed. The print head comprises a die (30) comprising a plurality of feed slots (40) having an aspect ratio greater than 2, each feed slot (40) comprising side wall surfaces (61); a protective coating disposed on each mentioned surface; and a plurality of firing chambers (47) in fluid communication with the feed slots (40), respectively, wherein the protective coating does not extend into the firing chambers (47) for more than 5 microns. In some cases, each feed slot of the print head further comprises at least one rib (41), each rib (41) comprising a top surface (68), two side surfaces (66), and an under surface (69), and the protective coating is disposed on the top surface (68), two side surfaces (66), and under surface (69) of each rib (41).

In some cases, the protective coating has substantially zero stress. In some cases, the protective coating is formed by self-ionized plasma physical vapor deposition. In some embodiments, the protective coating is formed from a material selected from the group consisting of titanium (Ti), titanium nitride (TiN), tungsten (W), tantalum (Ta), tantalum nitride (TaN) and combinations thereof. In some cases, the protective coating comprises at least two layers of the material.

In yet another embodiment, an inkjet cartridge is disclosed, comprising a print head assembly including the print head described herein and printing circuitry, and ink reservoir attached to the assembly.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The above discussion is meant to be illustrative of the principles and various embodiments of the present invention. Numerous variations and modifications will become apparent to those skilled in the art once the above disclosure is fully appreciated. For example, although SIP PVD is emphasized in the foregoing description, any other suitable coating technique capable of achieving the same result may be substituted. Also, it should be understood that coating materials other than those expressly described herein which are capable of serving the same purpose and are capable of being applied similarly may be substituted. It is intended that the following claims be interpreted to embrace all such variations and modifications.

What is claimed is:

1. A method, comprising creating a self-ionized plasma (SIP) of a coating material;

establishing a bias on a print head die comprising a plurality of feed slots, wherein each feed slot of the plurality of feed slots delivers fluid from a reservoir to a plurality of firing chambers, each said feed slot comprising side wall surfaces; and causing the coating material to be deposited on said surfaces to form a protective coating, wherein at least a portion of said coating material is deposited on at least a portion of said surfaces by resputtering.

2. The method of claim 1, wherein each said feed slot has an aspect ratio greater than 2:1.

3. The method of claim 1, wherein each said feed slot further comprising at least one rib, each rib comprising a top surface, two side surfaces, and an under surface, and wherein the formed protective coating is deposited on said top surface, two side surfaces, and under surface of each said rib.

4. The method of claim 1 wherein the coating material is selected from the group consisting of titanium (Ti), titanium nitride (TiN), tungsten (W), tantalum (Ta), tantalum nitride (TaN) and combinations thereof.

5. The method of claim 1 wherein the protective coating comprises at least two layers of said coating material.

6. The method of claim 1 wherein the protective coating comprises a layer of titanium (Ti) and a layer of titanium nitride (TiN), wherein the layer of titanium nitride (TiN) is the outermost layer.

7. The method of claim 1 wherein the formed protective coating has zero stress.

8. The method of claim 1 wherein the protective coating is transparent under visible light.

9. A method, comprising establishing a bias on a print head die comprising a plurality of feed slots wherein each feed slot of the plurality of feed slots delivers fluid from a reservoir to a plurality of firing chambers, each said feed slot comprising side wall surfaces; and causing a coating material to be deposited on said surfaces to form a protective coating, wherein at least a portion of said coating material is deposited on at least a portion of said surfaces, wherein the coating material does not extend into the plurality of firing chambers.

10. The method of claim 9, wherein each said feed slot has an aspect ratio greater than 2:1.

11. The method of claim 9, wherein each said feed slot further comprising at least one rib, each rib comprising a top surface, two side surfaces, and an under surface, and wherein the formed protective coating is deposited on said top surface, two side surfaces, and under surface of each said rib.

12. The method of claim 9 wherein the coating material is selected from the group consisting of titanium (Ti), titanium nitride (TiN), tungsten (W), tantalum (Ta), tantalum nitride (TaN) and combinations thereof.

13. The method of claim 9 wherein the protective coating comprises a layer of titanium (Ti) and a layer of titanium nitride (TiN), wherein the layer of titanium nitride (TiN) is the outermost layer.

14. The method of claim 1, wherein the coating material is tantalum nitride (TaN).

* * * * *

UNITED STATES PATENT AND TRADEMARK OFFICE

CERTIFICATE OF CORRECTION

PATENT NO. : 8,585,180 B2
APPLICATION NO. : 13/389709
DATED : November 19, 2013
INVENTOR(S) : Siddhartha Bhowmik et al.

It is certified that error appears in the above-identified patent and that said Letters Patent is hereby corrected as shown below:

On the Title page, in item (57), Abstract, in column 2, line 1, before "making" delete "method of".

Signed and Sealed this
Twenty-fifth Day of March, 2014

Michelle K. Lee

Michelle K. Lee
*Deputy Director of the United States Patent and Trademark Office*